US006925944B1

(12) United States Patent
Miller et al.

(10) Patent No.: US 6,925,944 B1
(45) Date of Patent: Aug. 9, 2005

(54) MULTIPLE-USE TABLE

(76) Inventors: Larry D. Miller, 3329 Laredo La., Ft. Collins, CO (US) 80526-4235; Karen C. Miller, 3329 Laredo La., Ft. Collins, CO (US) 80526

( * ) Notice: Subject to any disclaimer, the term of this patent is extended or adjusted under 35 U.S.C. 154(b) by 120 days.

(21) Appl. No.: 10/439,509

(22) Filed: May 16, 2003

(51) Int. Cl.[7] ..... A47B 3/00
(52) U.S. Cl. ..... 108/115
(58) Field of Search ..... 108/115, 137, 143, 108/77, 103, 102, 105

(56) References Cited

U.S. PATENT DOCUMENTS

| | | | | | |
|---|---|---|---|---|---|
| 2,129,041 | A | * | 9/1938 | Allred | 108/77 |
| D144,590 | S | * | 4/1946 | Schutes | D6/397 |
| 2,576,287 | A | | 11/1951 | English | |
| 2,603,500 | A | * | 7/1952 | Messier | 108/77 |
| 2,643,924 | A | * | 6/1953 | Albano | 108/77 |
| 3,415,208 | A | * | 12/1968 | Thoresen et al. | 108/94 |
| 3,436,092 | A | * | 4/1969 | Udo | 108/115 |
| 3,935,823 | A | | 2/1976 | England | |
| 4,709,641 | A | * | 12/1987 | Lenger | 108/143 |
| 4,903,614 | A | | 2/1990 | Johnson | |
| 6,000,343 | A | | 12/1999 | Laney | |
| 6,289,824 | B1 | * | 9/2001 | Parker et al. | 108/115 |
| 6,314,892 | B1 | | 11/2001 | Favini | |
| 6,405,660 | B2 | * | 6/2002 | Itakura et al. | 108/115 |
| 6,474,677 | B2 | * | 11/2002 | Kasuya | 108/115 |
| 6,615,744 | B1 | * | 9/2003 | Eckstein et al. | 108/147.2 |

OTHER PUBLICATIONS

2003 Camping World catalog, pp. 162-163.

* cited by examiner

*Primary Examiner*—Jose V. Chen
(74) *Attorney, Agent, or Firm*—William E. Hein

(57) ABSTRACT

A table which may be quickly and easily reconfigured to meet the present needs of the user includes a base having left and right side members, front and rear slat members, and a bottom member extending therebetween, the foregoing members defining a magazine storage area within the base, a sub-top extending between the left and right side members and being arranged for vertical sliding engagement with respect to the side members to facilitate height adjustment of the sub-top with respect to the base, a table top having a rectangular central top member and drop leaves hingedly attached to respective ones of longer sides of the top member, each of the drop leaves being movable between a horizontal position and a depending vertical position, the top member being mounted on the sub-top such that the table top may be rotated ninety degrees in either direction with respect to the base.

8 Claims, 4 Drawing Sheets

Fig. 5B
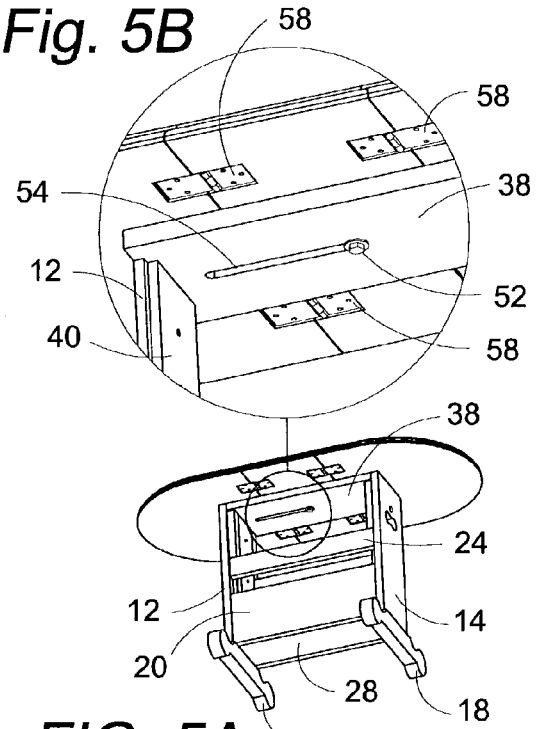
FIG. 5A
Fig. 6A
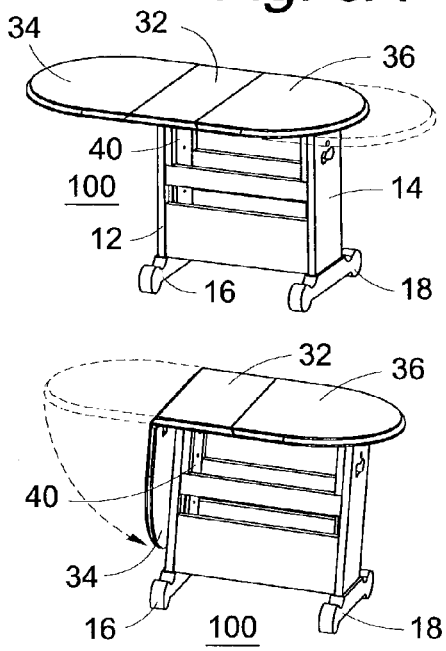
FIG. 6B
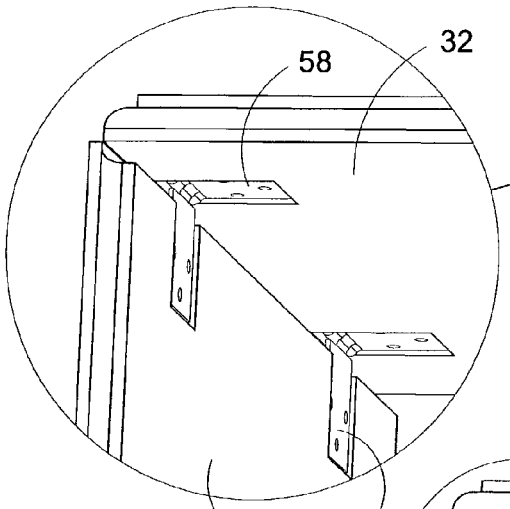
FIG. 7C
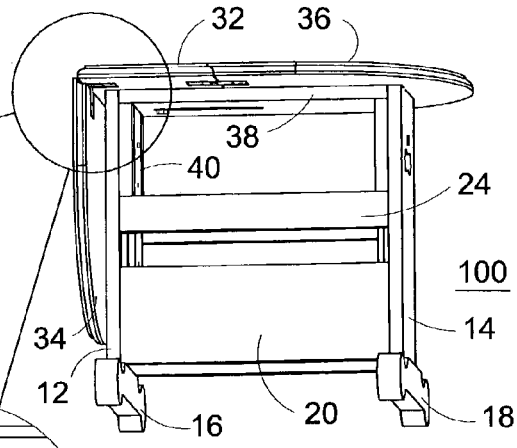
Fig. 7A
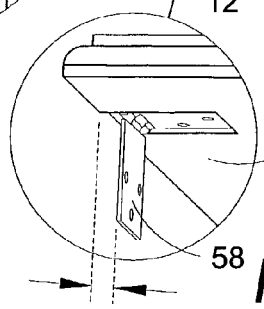
FIG. 7B

MULTIPLE-USE TABLE

BACKGROUND AND SUMMARY OF THE INVENTION

This invention relates to tables of the type that may be employed, for example, in the home or in a recreational vehicle and, more specifically, to a table that may be quickly and easily reconfigured to meet the present needs of the user.

Tables of various types are known in the prior art. However, most known tables have a fixed configuration and are thus used in a single intended application. Some known tables include drop leaves, folding bases, hinged table tops, height-adjustable legs, collapsible tops and bases, etc. in attempts to expand their utility and to provide for portability and compact storage.

It would be advantageous to provide a table whose configuration can be quickly and easily changed to meet the immediate needs of the user, whether they are based on functionality or space limitations. Such a table is provided, in accordance with the illustrated embodiment of the present invention, by employing a base having left and right side members, front and rear slat members, and a bottom member extending therebetween, the left and right side members, front and rear slat members, and bottom member defining a magazine storage area within the base, a sub-top extending between the left and right side members and being arranged for vertical sliding engagement with the side members for facilitating adjustment of the height of the sub-top, the sub-top having a longitudinal centrally positioned slot therein, the slot extending from a central point in the sub-top to a point proximate an end thereof, a table top having a rectangular central top member and two drop leaves hingedly attached to respective ones of longer sides of the central top member, each of the drop leaves being movable between a horizontal position and a depending vertical position, and means for mounting the central top member on top of the sub-top such that the table top may be rotated ninety degrees in either direction with respect to the base.

BRIEF DESCRIPTION OF THE DRAWINGS

FIG. 5A is a pictorial diagram of the table of FIG. 1 illustrating its underside.

FIG. 5B is a detailed diagram of a portion of the underside of the table of FIG. 5A illustrating a longitudinal slot in the base along which the top may be translated.

FIG. 6A is pictorial diagram of the table of FIG. 1 illustrating how the top may be moved from a position in which it is centered over the base with both drop leaves in the horizontal position to a position in which one of the drop leaves extends over one end of the base in preparation for being dropped to a depending vertical position.

FIG. 6B is a pictorial diagram of the table of FIG. 6A in which the drop leaf extending over the end of the base has been dropped to the depending vertical position at the end of the base.

FIGS. 7A–C illustrate the details of how the drop leaves of the table of the present invention are hinged to the central portion of the table top.

DETAILED DESCRIPTION OF THE PREFERRED EMBODIMENT

Figure 1:
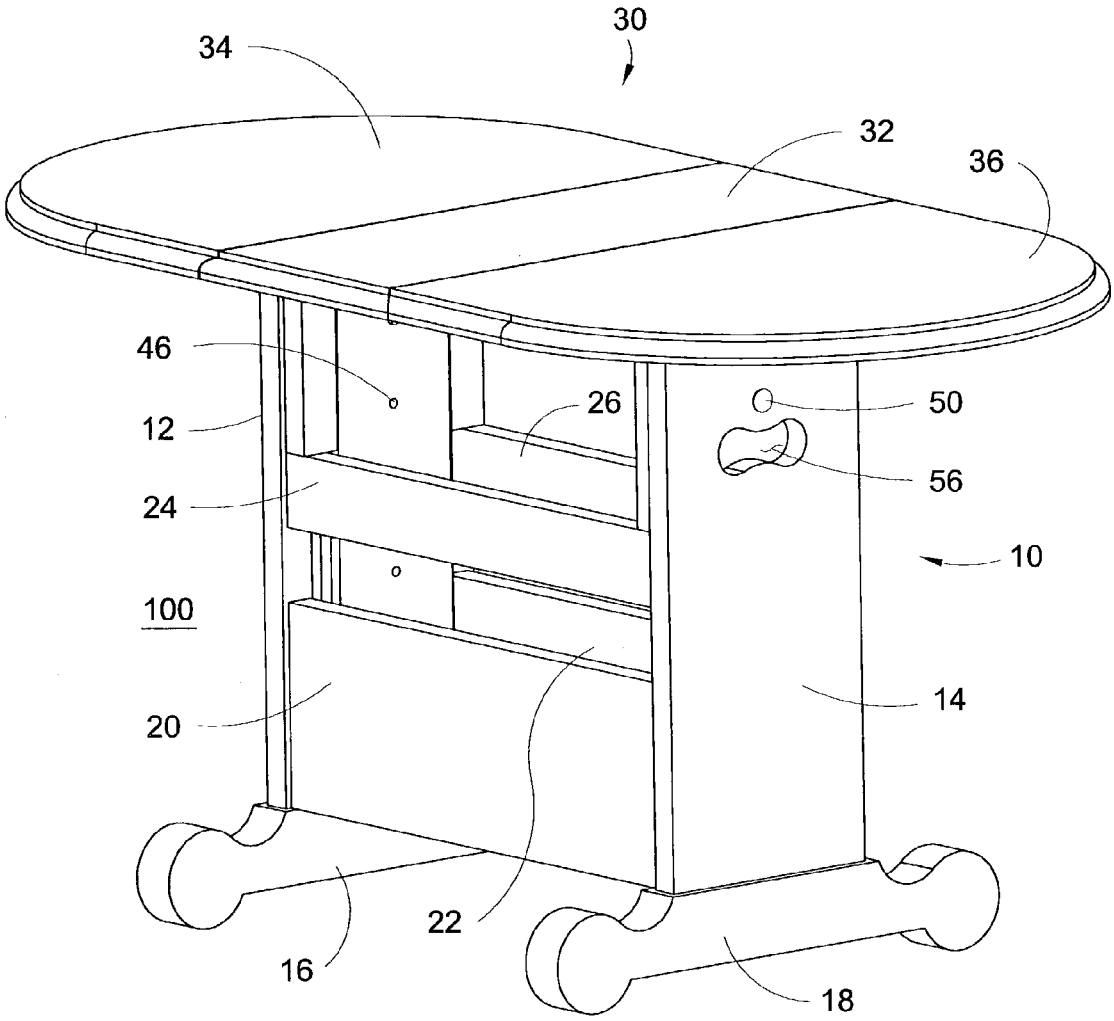
FIG. 1 is an overall pictorial diagram of the multiple-use table of the present invention.

Referring now to FIG. 1, there is shown a table 100 constructed in accordance with the present invention. Table 100 includes a base 10 having left and right side members 12, 14 and left and right foot members 16, 18 attached at bottom ends thereof. Four front and rear slat members 20, 22, 24, 26 and a bottom member 28 extend between left and right side members 12, 14 to support them and to define an open area in base 10 that is suitable for magazine storage, for example. A folding table top 30 includes a rectangular central top member 32 and two drop leaves 34, 36 that are hingedly attached thereto. As illustrated in FIGS. 7A–C, drop leaves 34, 36 are attached along opposite edges of the underside of central top member 32 by means of a pair of conventional hinges 58, each side of which is recessed into the bottom surfaces of central top member 32 and the corresponding one of drop leaves 34, 36. In addition, each of the hinges 58 is mounted on the bottom surface of central top member 32 in a position such that the centerline of each of the hinges 58 is recessed slightly inwardly from the outer edge of central top member 32, as illustrated in FIG. 7B. This important feature of the present invention allows the entire peripheral edge of central top member 32 to be decoratively shaped and further allows the hinged edge of drop leaves 34, 36 to be matingly shaped so as to result in a mating fit between the hinged edge of each of the drop leaves 34, 36 and the adjacent peripheral edge of central top member 32 when drop leaves 34, 36 are raised to their horizontal position. In addition, this recessed hinge feature serves to hide hinges 58 from view when drop leaves 34, 36 are in the depending vertical position of FIG. 4.

Figure 2:
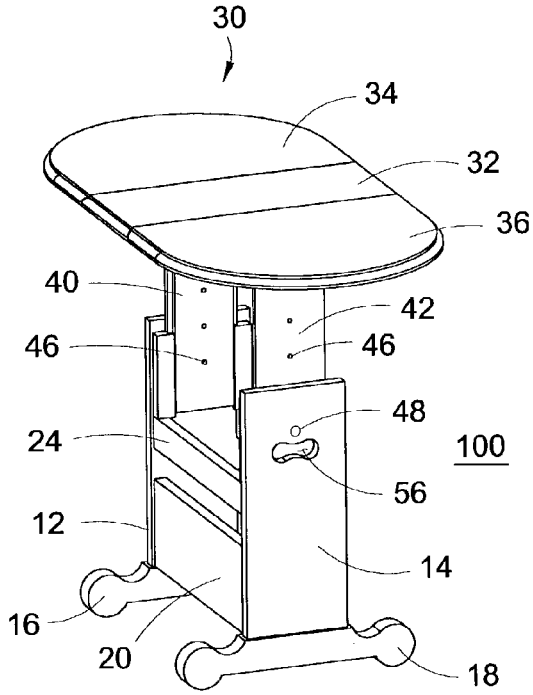
FIG. 2 is a pictorial diagram of the table of FIG. 1 illustrating the top in a raised position.
Figure 3:
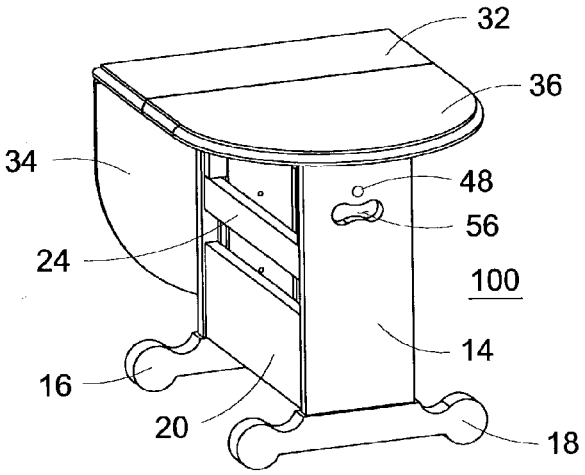
FIG. 3 is a pictorial diagram of the table of FIG. 1 illustrating the configuration in which one drop leaf depends vertically at one end of the base.
Figure 8:
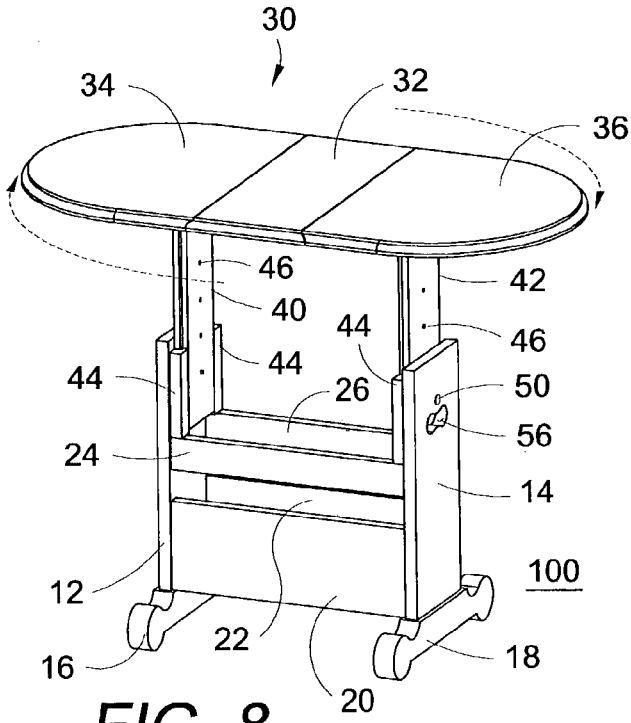
FIG. 8 is a pictorial diagram of the table of the present invention indicating that the top may be rotated ninety degrees from the configuration shown, in which both drop leaves are in the horizontal position, to the configuration illustrated in FIG. 4, in which both drop leaves depend vertically in front of and behind the base.
Figure 9:
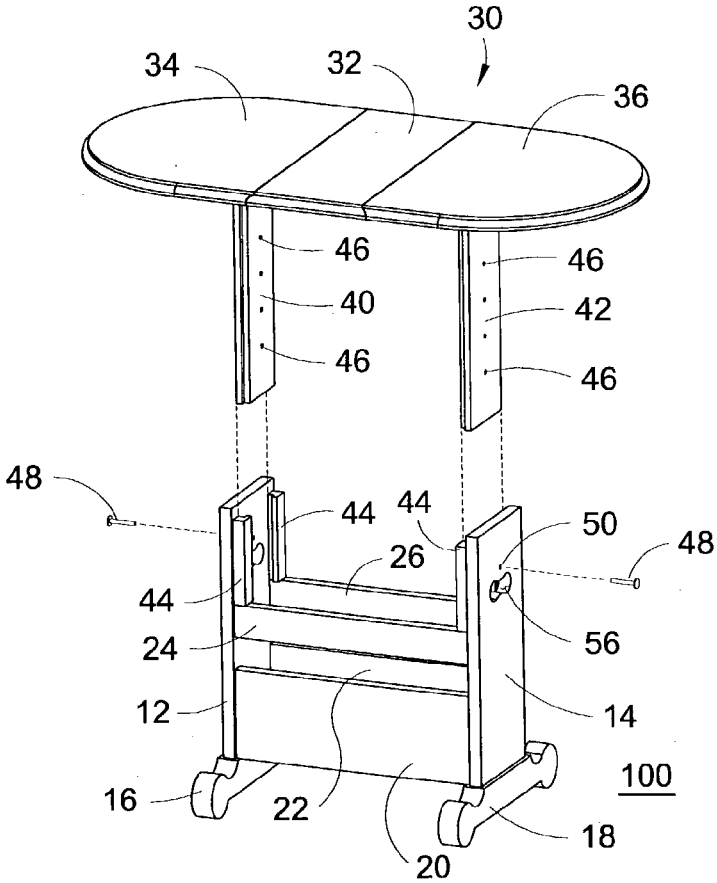
FIG. 9 is a pictorial diagram of the table of FIG. 8 illustrating how the height of the table is adjusted.

As shown in FIGS. 5A–B, 7A, 8, and 9, table top 30 is connected to base 10 by means of a sub-top 38. A pair of downwardly extending side rails 40, 42 are fixedly attached to sub-top 38 at opposite ends thereof. Side rails 40, 42 are arranged for sliding engagement with channels 44 formed on the inside surface of each of the left and right side members 12, 14. Each of the side rails 40, 42 includes a plurality of vertically-aligned height adjustment holes 46. As illustrated in FIGS. 8 and 9, height adjustment of table top 30 is achieved by inserting a removable adjustment pin 48 through a hole 50 provided in each of side members 12, 14 and into a desired one of the height adjustment holes 46 in each of the side rails 40, 42. In this manner the height of table top 30 can be variably set between its lowest position, illustrated in FIGS. 1, 3, 4, 5A, 6A–B, and 7A, and its highest position, illustrated in FIGS. 2 and 8.

Table top 30 is rotationally attached to sub-top 38 by means of a bolt 52 threaded into a bushing that is centrally embedded in the bottom surface of table top 30. The shaft of bolt 52 resides in a slot 54 that is provided in sub-top 38. Slot 54 is longitudinally centrally positioned in sub-top 38 such that it extends from near the center thereof to near one end thereof. As shown in FIGS. 6A–B, table top 30 may thus be translated from its position illustrated in FIG. 1 to that of FIGS. 3, 6B, and 7A, in which drop leaf 34 is in a depending vertical position. By limiting the length of slot 54 from the center to one end of sub-top 38, the user can be assured that table top 30 is centered over base 10 by simply sliding table top 30 toward the longitudinal center of base 10 as far as slot 54 will permit. If slot 54 were extended beyond the center of sub-top 38, the user would then find it difficult to center table top 30 over base 10. Table top 30 may also simply be rotated ninety degrees from its position illustrated in FIG. 1 to that of FIG. 4, in which both drop leaves 34, 36 are in the depending vertical position. A hand hold opening 56 is provided in each of the side members 12, 14 of base 10 to facilitate lifting and relocation of table 100 when it is in the configuration of FIG. 4.

Figure 4:
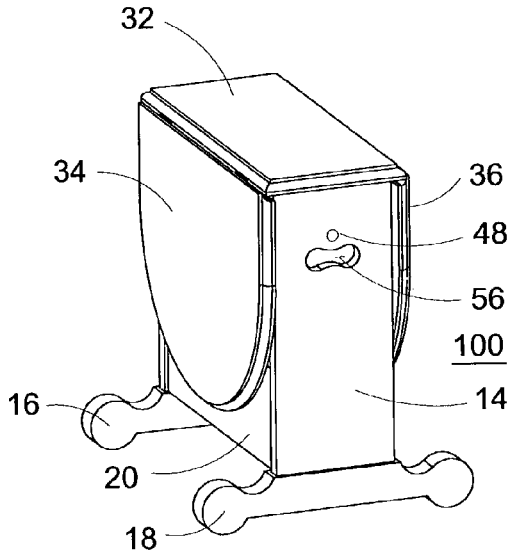
FIG. 4 is a pictorial diagram of the table of FIG. 1 illustrating the configuration in which the top is rotated ninety degrees and both drop leaves depend vertically alongside the base.

In use, the above-described table 100 of the present invention may be quickly and easily configured to meet the current needs of the user. As illustrated in FIG. 1, table 100 may be configured such that table top 30 is longitudinally aligned with base 10 with both drop leaves 34, 36 in their horizontal positions. From that configuration, table top 30 may be simply rotated ninety degrees in either the clockwise or counter clockwise direction such that central top member 32 becomes longitudinally aligned with base 10 and both drop leaves 34, 36 are permitted to depend vertically in front of and behind base 10, as illustrated in FIG. 4. From the configuration illustrated in FIG. 1, table top 30 may be simply translated to the left, as indicated in FIG. 6A, such that drop leaf 34 is permitted to depend vertically alongside base 10, as illustrated in FIGS. 4, 6B, and 7B. While table 100 is in any of the configurations just described, the height of table top 30 may be adjusted to meet the needs of the user, as illustrated in FIGS. 8 and 9 and as described in detail hereinabove.

We claim:

1. A multiple-function table comprising:

a base having left and right side members, front and rear slat members, and a bottom member extending therebetween, said left and right side members, front and rear slat members, and bottom member defining a storage area within the base;

a sub-top extending between said left and right side members and having a pair of downwardly extending side rails fixedly attached thereto, said side rails being arranged for vertical sliding engagement with an inside surface of respective ones of said left and right side members, said side rails having a plurality of spaced apart vertically-aligned height adjustment holes therein to facilitate adjustment of the height of said sub-top, said sub-top having a longitudinal centrally positioned slot therein, said slot extending only from a central point in said sub-top to a point proximate an end thereof;

a table top having a rectangular central top member and two drop leaves hingedly attached to respective ones of longer sides of said central top member, each of said drop leaves being movable between a horizontal position and a depending vertical position; and attachment means for rotationally mounting said central top member on top of said sub-top.

2. A multiple-function table as in claim 1, wherein;

an entire peripheral edge of said central top member and an entire outer peripheral edge of each of said drop leaves are decoratively shaped alike; and an inner peripheral edge, proximate a respective one of said longer sides of said central top member, of each of said drop leaves is decoratively shaped to matingly engage said decoratively shaped peripheral edge of said proximate respective one of said longer sides of said central top member when said drop leaves are in the horizontal position.

3. A multiple-function table as in claim 2, further comprising a plurality of hinges for attaching each of said drop leaves to said respective ones of said longer sides of said central top member, each of said hinges being attached to both an underside of said drop leaves and said central top member and being positioned such that a centerline of said hinges is recessed inwardly from an outer edge of respective ones of said longer sides of said central top member to thereby hide said hinges from view when said drop leaves are in the depending vertical position.

4. A multiple-function table as in claim 1, wherein said left and right side members of said base include channels formed on said inside surface thereof for receiving and guiding said side rails.

5. A multiple-function table as in claim 1, wherein each of said left and right side members includes a height adjustment hole for removably receiving an adjustment pin when said table top is raised or lowered such that a desired one of said height adjustment holes in each of said side rails is in alignment with said height adjustment hole in each of said left and right side members.

6. A multiple-function table as in claim 1, wherein each of said left and right side members includes a hand hold opening therein to allow a user to lift and relocate said table.

7. A multiple-function table as in claim 1, further comprising a foot member attached at a bottom end of each of said left and right side members of said base.

8. A multiple-function table as in claim 1, wherein said attachment means comprises a threaded bushing centrally embedded in the bottom surface of said central top member of said table top and a bolt residing in said slot and threaded into said bushing.

* * * * *